US008826822B1

(12) United States Patent
Huang

(10) Patent No.: US 8,826,822 B1
(45) Date of Patent: Sep. 9, 2014

(54) ROCKET WITHOUT TAIL FLAME

(71) Applicant: Jian-Lin Huang, Tainan (TW)

(72) Inventor: Jian-Lin Huang, Tainan (TW)

( * ) Notice: Subject to any disclaimer, the term of this patent is extended or adjusted under 35 U.S.C. 154(b) by 0 days.

(21) Appl. No.: 13/868,910

(22) Filed: Apr. 23, 2013

(51) Int. Cl.
*F02K 9/76* (2006.01)
*F42B 15/00* (2006.01)

(52) U.S. Cl.
CPC ..... *F42B 15/00* (2013.01)
USPC ..... 102/352; 102/347; 102/376

(58) Field of Classification Search
CPC ..... F42B 15/00; F42B 15/36; F02K 9/76; F02K 9/763
USPC ..... 102/347–352, 376; 89/1.813, 1.816, 89/1.82
See application file for complete search history.

(56) References Cited

U.S. PATENT DOCUMENTS 1,191,299 A * 7/1916 Goddard ..... 60/250
2,500,117 A * 3/1950 Chandler ..... 60/201
2,524,591 A * 10/1950 Chandler ..... 60/201
2,884,859 A * 5/1959 Alexander et al. ..... 102/376
2,945,442 A * 7/1960 Adelman et al. ..... 102/378
3,245,350 A * 4/1966 Kelly ..... 89/1.808
3,648,616 A * 3/1972 Hsu ..... 102/443
3,735,706 A * 5/1973 Elstow et al. ..... 102/340
3,886,841 A * 6/1975 Smith et al. ..... 89/1.3
4,036,456 A * 7/1977 Skinner et al. ..... 244/122 AD
4,232,843 A * 11/1980 Clark et al. ..... 244/3.29
6,666,144 B1 * 12/2003 Kim et al. ..... 102/374
2009/0212163 A1 * 8/2009 Shi ..... 244/171.1
2012/0210898 A1 * 8/2012 Ritchie ..... 102/226

* cited by examiner

*Primary Examiner* — Bret Hayes
*Assistant Examiner* — Joshua Freeman
(74) *Attorney, Agent, or Firm* — Muncy, Geissler, Olds & Lowe, P.C.

(57) ABSTRACT

A rocket without tail flame includes an outer socket which receives an ignition unit, a first bullet, a second powder filling unit, a hollow aluminum tube and a second bullet therein. A rocket head is fixed to the outer socket. The firing pin of the rocket launcher hits the primer of the second bullet to shoot the head of the second bullet, the rocket is launched from the rocket launcher. No tail flame is generated because only the powder in the second bullet is ignited. The head of the second bullet hits the firing pin of the ignition unit to ignite the primer of the first bullet so that the first powder of the first bullet is ignited. The second powder in the second powder filling unit is ignited after the rocket flies 3-5 seconds. There are two stages of ignition, and the rocket can carry heavier load.

4 Claims, 7 Drawing Sheets

A - A

B - B

ROCKET WITHOUT TAIL FLAME

FIELD OF THE INVENTION

The present invention relates to a rocket, and more particularly, to a rocket without tail flame and the rocket has two stages of ignition process.

BACKGROUND OF THE INVENTION

A conventional rocket is shown in FIG. 7 and generally includes only one stage of ignition and comprises a casing (B) which is connected between a head (C) and a bullet (D) which is inserted into the casing (B). When the rocket is put in the rocket launcher, the firing pin hits the bullet (D) which ignites the powder in the casing (B), and the powder burns and expands the air in the casing (B). The expanded air generates a force to launch the head (C) from the launcher.

There will be a tail flame generated when the powder in the casing (B) burns within a short period of time for the one stage ignition rocket. For one stage rocket, the load of the head (C) is restricted in order to have longer distance of flight. When the load of the head (C) is too high, the rocket can only reach a short distance.

The present invention intends to provide a rocket which has two stages of ignition process and no tail flame is generated when launching out from a rocket launcher.

SUMMARY OF THE INVENTION

The present invention relates to a rocket without tail flame and comprises an ignition unit having a carrier with two open ends. A flange extends from outside of the carrier and a stop is connected to one end of the carrier. A firing pin is located in the carrier and supported by the stop. A resilient member is mounted to the firing pin. A first bullet has a casing which has multiple first holes defined therethrough, and a primer is connected to one end of the casing. A first bullet has a hollow plastic tube located in the casing and a first powder is located in the hollow plastic tube. A cap is mounted to the casing. The end with the primer of the first bullet is fixed to the carrier and the primer is stopped by the resilient member and located corresponding to the firing pin. A second powder filling unit has a socket which has a first end and a second end, wherein the first and second ends are open ends. A mounting hole, multiple propelling holes and a first fixing portion are formed in the first end. The mounting hole is mounted to the first bullet and the carrier, and stopped by the flange. The second powder filling unit has a plastic collar located in the socket and mounted to the carrier. A plastic cup is located in the socket and mounts to the first bullet so as to have a powder chamber in the socket. The powder chamber is separated from the first bullet. A second powder is located in the powder chamber and a cover is mounted to the second end of the socket. A hollow aluminum tube has multiple second holes defined therethrough and is mounted to the carrier. A second bullet has a head and inserted into the hollow aluminum tube. The head is located corresponding to the firing pin of the ignition unit. An outer socket accommodates the ignition unit, the first bullet, the second powder filling unit, the hollow aluminum tube and the second bullet. The outer socket has a second fixing portion which is fixed to the first fixing portion of the socket of the second powder filling unit. A rocket head is fixed to the outer socket.

Preferably, the first fixing portion of the socket of the second powder filling unit is two notches which are recessed from the first end toward the second end. The second fixing portion of the outer socket is bolts extending through the outer socket.

Preferably, the head of the second bullet is a plastic head.

Preferably, the propelling holes of the socket are inclined by 20 degrees, and the outer socket has a plurality of inclined holes therethrough.

One aspect of the present invention is to provide a rocket without tail flame and the rocket has two stages of ignition so as to carry heavier load and does not have tail flame.

Another aspect of the present invention is that the head of the second bullet is a plastic head which does not penetrate through the first bullet to cause unexpected danger.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
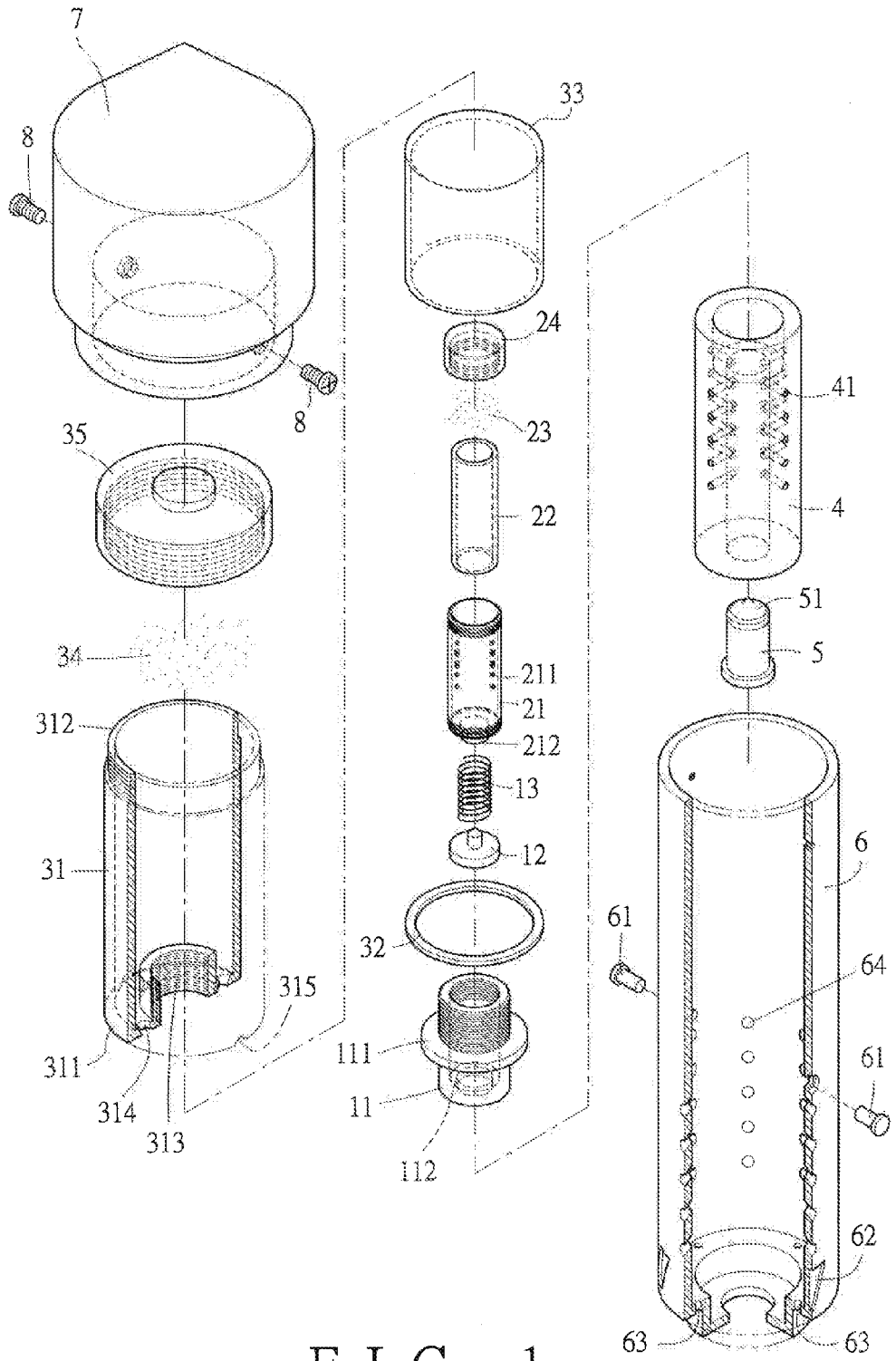
FIG. 1 is an exploded view to show the rocket of the present invention.

Referring to FIGS. 1 to 4, the rocket of the present invention comprises an ignition unit 1 having a carrier 11 which has two open ends. A flange 111 extends from the outside of the carrier 11. A stop 112 is connected to one end of the carrier 11. A firing pin 12 is located in the carrier 11 and supported by the stop 112. A resilient member 13 is mounted to the firing pin 12.

A first bullet 2 has a casing 21 which has multiple first holes 211 defined therethrough. A primer 212 is connected to one end of the casing 21. The first bullet 2 has a hollow plastic tube 22 located in the casing 21 and a first powder 23 is located in the hollow plastic tube 22. A cap 24 is mounted to the casing 21. The end with the primer 212 of the first bullet 2 is fixed to the carrier 11, and the primer 212 is stopped by the resilient member 13 and located corresponding to the firing pin 12.

A second powder filling unit 3 has a socket 31 which has a first end 311 and a second end 312, wherein the first and second ends 311, 312 are open ends. A mounting hole 313, multiple propelling holes 314 and a first fixing portion are formed in the first end 311. In this embodiment, the propelling holes 314 of the socket 31 are inclined by 20 degrees. The first fixing portion includes two notches 315. Preferably, the two notches 315 are recessed from the first end 311 to the second end 312. The mounting hole 313 is mounted to the first bullet 2 and the carrier 11 and stopped by the flange 111. Adhesive is used to connect the socket 31 and the carrier 11. The second powder filling unit 3 has a plastic collar 32 located in the socket 31 and mounted to the carrier 11. A plastic cup 33 is located in the socket 31 and mounts to the first bullet 2 so as to form a powder chamber 316 in the socket 31. The powder chamber 316 is separated from the first bullet 2. A second powder 34 is located in the powder chamber 316 and a cover 35 is mounted to the second end 312 of the socket 31.

A hollow aluminum tube 4 has multiple second holes 41 defined therethrough, the aluminum tube 4 is mounted to the carrier 11 and located in opposite the socket 31. Adhesive is used to fix the aluminum tube 4 to the carrier 11.

A second bullet 5 has a plastic head 51 and is inserted into the hollow aluminum tube 4, so that the plastic head 51 is located corresponding to the firing pin 12 of the ignition unit 1.

An outer socket 6 accommodates the ignition unit 1, the first bullet 2, the second powder filling unit 3, the hollow aluminum tube 4 and the second bullet 5. The outer socket 6 has a second fixing portion which is fixed to the first fixing portion of the socket 31 of the second powder filling unit 3. The second fixing portion of the outer socket 6 is bolts 61 extending through the outer socket 6. The notches 315 are engaged with the bolts 61 to set the socket 31 on the outer socket 6. The outer socket 6 has multiple inclined slots 62 defined around the outer socket 6 and multiple through holes 63 are defined in the lower end of the outer socket 6. Preferably, the outer socket 6 has a plurality of inclined holes 64 therethrough. The inclined holes 64 are inclined toward the bottom of the outer socket 6. A rocket head 7 is fixed to the outer socket 6 by bolts 8 so as to complete the overall assembly of the rocket of the present invention.

Figure 2:
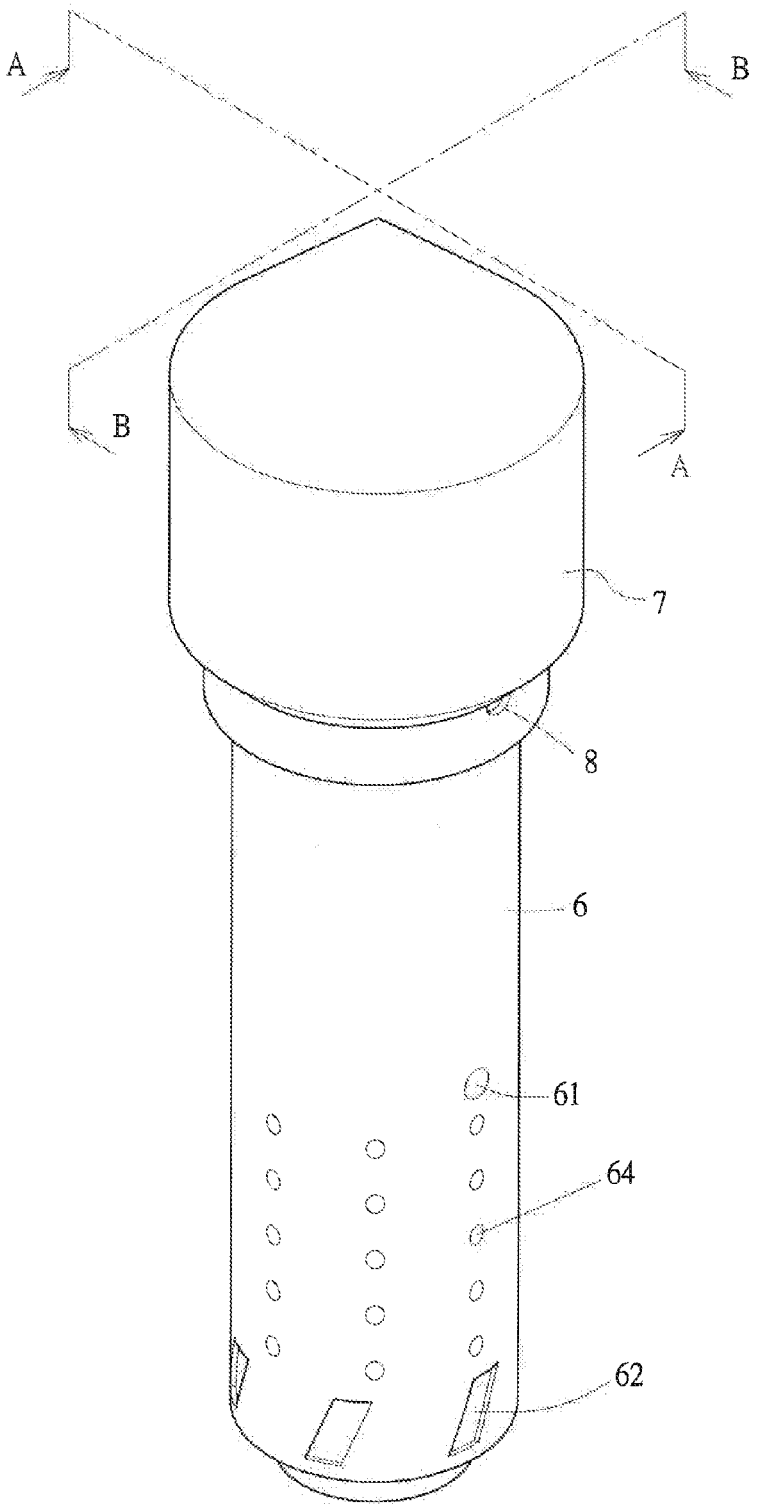
FIG. 2 is a perspective view to show the rocket of the present invention.
Figure 3:
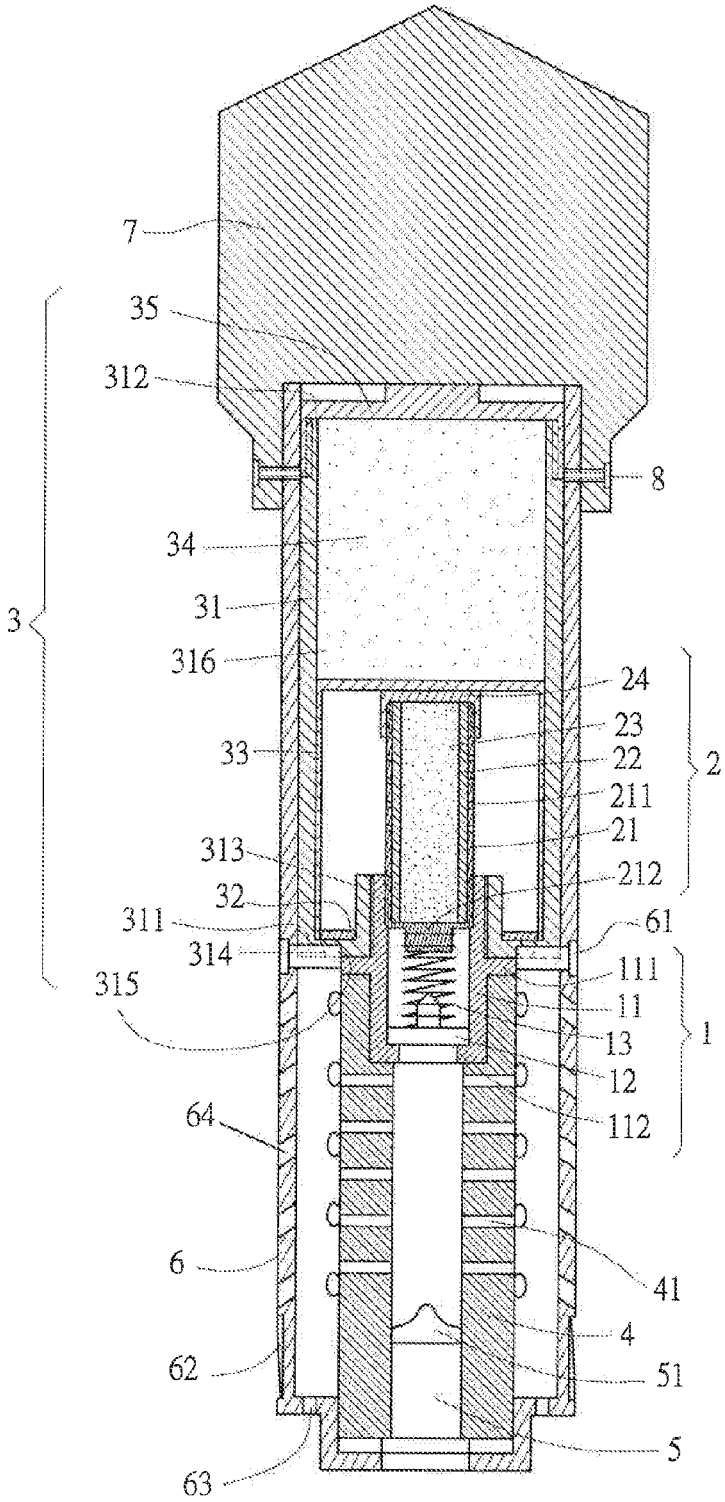
FIG. 3 is a cross sectional view taken along line AA of FIG. 2.
Figure 4:
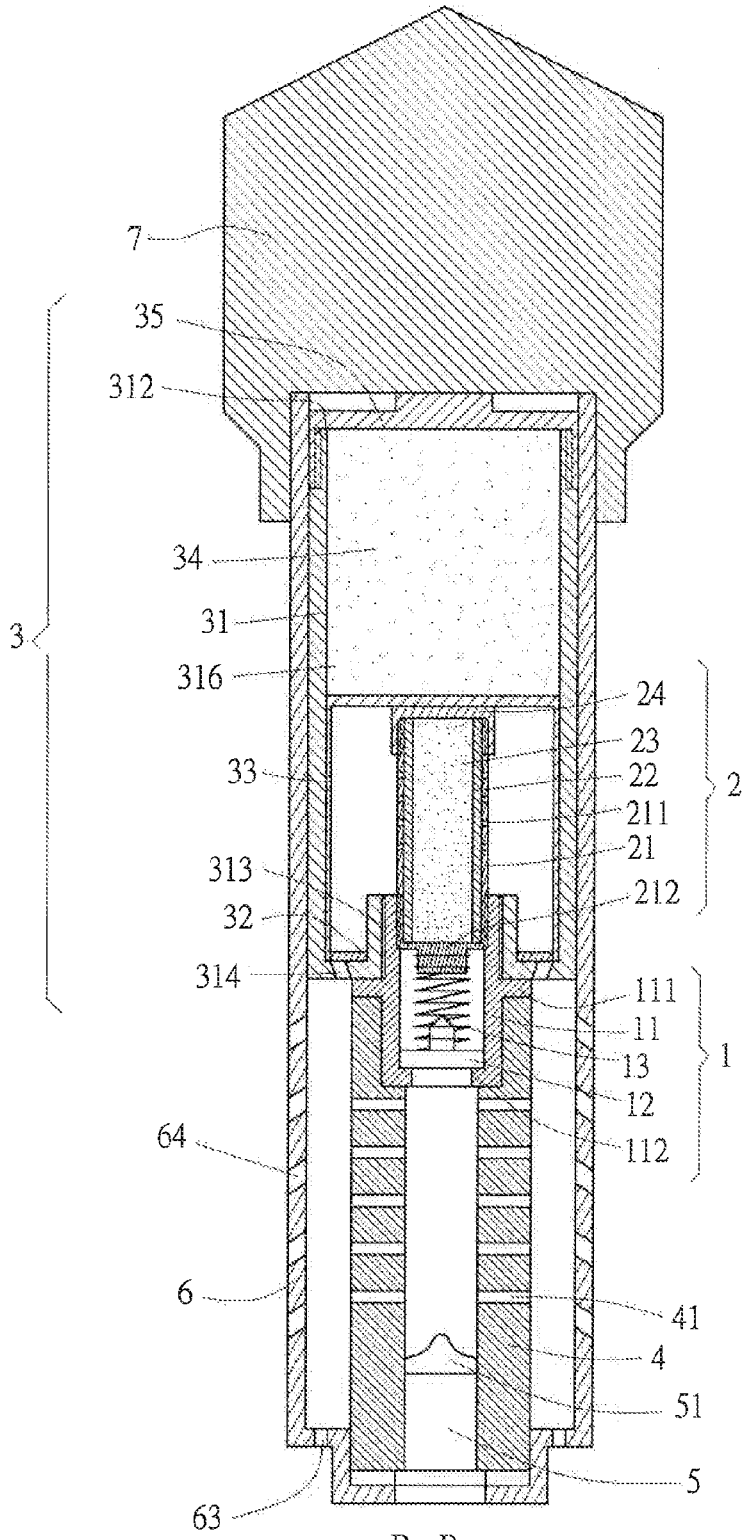
FIG. 4 is a cross sectional view taken along line BB of FIG. 2.

As shown in FIG. 2, by the inclined slots 62 of the outer socket 6, the rocket is spirally inserted into the rocket launcher and this is known in the art, and the rocket launcher is not shown in the drawings. When the rocket is launched, the rocket spirally flies out from the launcher and can cause severe damage.

Figure 5:
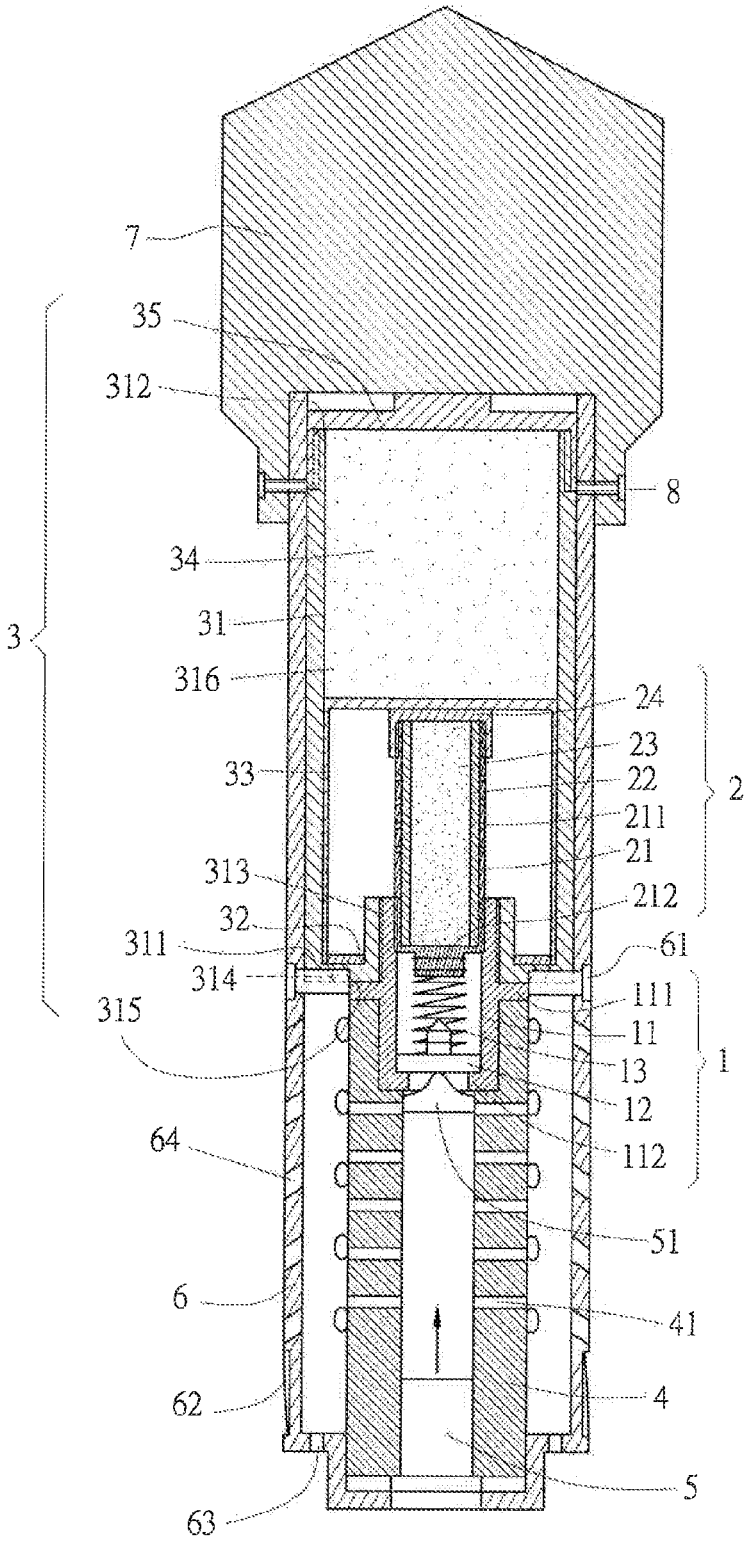
FIG. 5 shows that the plastic head of the second bullet hits the firing pin of the ignition unit.

As shown in FIG. 5, when the rocket is launched from the rocket launcher, the firing pin in the rocket launcher hits the primer of the second bullet 5, so that the plastic head 51 of the second bullet 5 shoots. Then the plastic head 51 moves along the hollow aluminum tube 4 and hits the firming pin 12 of the ignition unit 1. The power in the second bullet 5 burns and expands the air which is released from the second holes 41 of the hollow aluminum tube 4 and the through holes 63 of the outer socket 6 to eject the rocket from the rocket launcher. Because only the powder in the second bullet 5 is ignited while the rocket is shot from the rocket launcher, no tail flame is generated.

Figure 6:
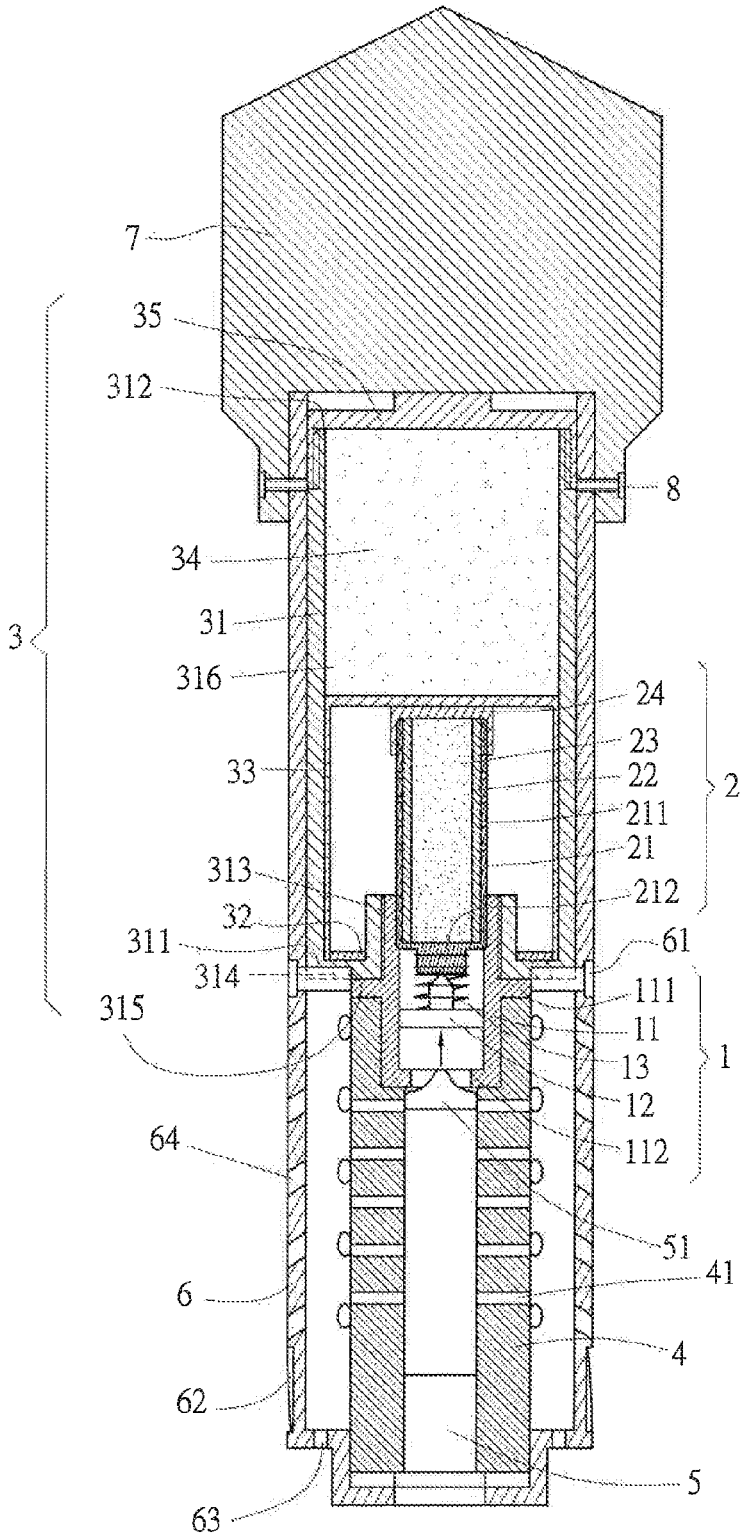
FIG. 6 shows that the firing pin of the ignition unit hits the primer of first bullet and the first powder burns the hollow plastic tube, the plastic collar and the plastic cup so as to ignite the second power.
Figure 7:
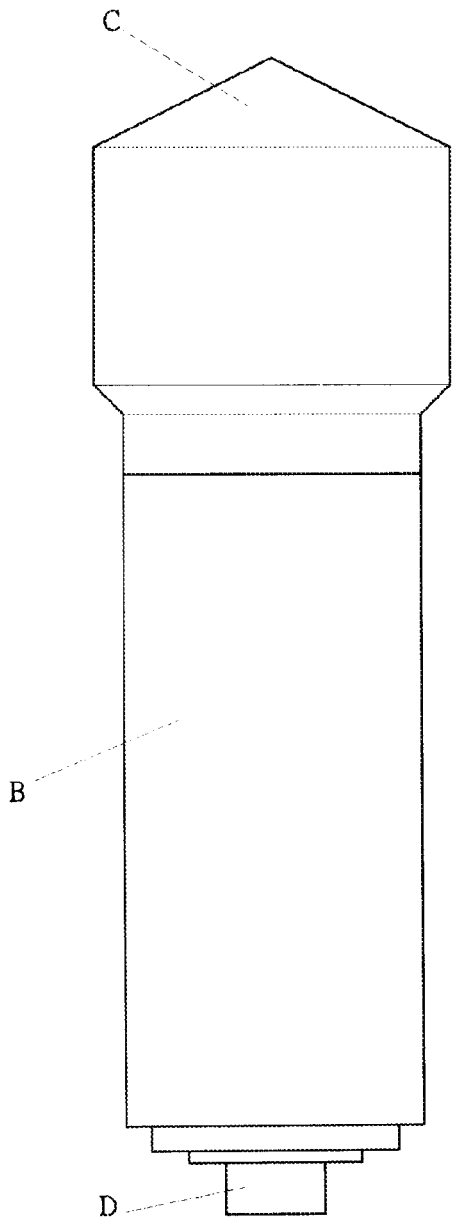
F I G . 7 ( Prior Art )
FIG. 7 shows the conventional rocket.

As shown in FIG. 6, after the plastic head 51 hitting the firming pin 12, the fire pin 12 compresses the resilient member 13 and hits the primer 212 of the bullet 2 so as to ignite the first powder 23. The first powder 23 burns the hollow plastic tube 22 during the burning of the first powder 23, and the corresponding expanded air is released from the first holes 211 of the casing 21, the propelling holes 314 of the socket 31 and the through holes 63 and the inclined holes 64 of the outer socket 6. During the exhausting period of the expanded air, the rocket flies 3 to 5 seconds, and the inclined propelling holes 314, inclined by 20 degrees, and the inclined holes 64, inclined toward the bottom of the outer socket 6, make the rocket to accelerate and spin so as to have severe damage. In the meanwhile, the high temperature during the burning of the first powder 23 burns the plastic collar 32 and the plastic cup 33 of the second powder filling unit 3. When the plastic cup 33 is burned, the second powder 34 in the powder chamber 316 of the socket 31 is ignited to achieve the second ignition.

By the two stages of ignition, the rocket can carry heavier rocket head 7 and can fly longer distance.

While we have shown and described the embodiment in accordance with the present invention, it should be clear to those skilled in the art that further embodiments may be made without departing from the scope of the present invention.

What is claimed is:

1. A rocket without tail flame, comprising:

an ignition unit having a cal tier which has two open ends, a flange extending from an outside of the carrier, a stop connected to one end of the carrier, a firing pin located in the carrier and supported by the stop, a resilient member mounted to the firing pin;

a first bullet having a casing which has multiple first holes defined therethrough, a primer connected to one end of the casing, the first bullet having a hollow plastic tube located in the casing, a first powder located in the hollow plastic tube, a cap mounted to the casing, the end with the primer of the first bullet being fixed to the carrier, the primer being stopped by the resilient member and located corresponding to the firing pin;

a second powder filling unit having a socket which has a first end and a second end, the first and second ends being open ends, a mounting hole, multiple propelling holes and a first fixing portion formed in the first end, the mounting hole being mounted to the first bullet and the carrier and stopped by the flange, the second powder filling unit having a plastic collar located in the socket and mounted to the carrier, a plastic cup located in the socket and mounting to the first bullet so as to have a powder chamber in the socket, the powder chamber being separated from the first bullet, a second powder located in the powder chamber, a cover mounted to the second end of the socket;

a hollow aluminum tube having multiple second holes defined therethrough, the aluminum tube mounted to the carrier;

a second bullet having a head and inserted into the hollow aluminum tube, the head located corresponding to the firing pin of the ignition unit;

an outer socket accommodating the ignition unit, the first bullet, the second powder filling unit, the hollow aluminum tube and the second bullet, the outer socket having a second fixing portion which is fixed to the first fixing portion of the socket of the second powder filling unit; and a rocket head fixed to the outer socket.

2. The rocket as claimed in claim 1, wherein the first fixing portion of the socket of the second powder filling unit is two notches which are recessed from the first end toward the second end, the second fixing portion of the outer socket is bolts extending through the outer socket.

3. The rocket as claimed in claim 1, wherein the head of the second bullet is a plastic head.

4. The rocket as claimed in claim 1, wherein the propelling holes of the socket are inclined by 20 degrees, and the outer socket has a plurality of inclined holes therethrough.

* * * * *